United States Patent [19]

Oke et al.

[11] 3,984,928

[45] Oct. 12, 1976

[54] CORNER REINFORCEMENT FOR VARIOUS SIZED LOADER BUCKETS

[75] Inventors: Stanley A. E. Oke, Batavia; Jerome A. Thies, Kaneville, both of Ill.

[73] Assignee: Caterpillar Tractor Co., Peoria, Ill.

[22] Filed: July 11, 1975

[21] Appl. No.: 595,201

[52] U.S. Cl. ..... 37/141 R

[51] Int. Cl.[2] ..... E02F 9/28

[58] Field of Search ..... 37/141 R, 141 T, 142 R, 37/142 A; 172/719

[56] References Cited

UNITED STATES PATENTS

| | | | |
|---|---|---|---|
| 3,014,293 | 12/1961 | Boatman et al. | 37/141 R |
| 3,648,391 | 3/1972 | Kabay et al. | 37/141 T |
| 3,736,675 | 6/1973 | Shankwitz | 37/141 R |
| 3,750,761 | 8/1973 | Smith et al. | 37/141 R X |
| 3,775,879 | 12/1973 | Quick | 37/141 T X |

FOREIGN PATENTS OR APPLICATIONS

| | | | |
|---|---|---|---|
| 69,773 | 1/1969 | Germany | 37/141 R |
| 1,117,386 | 6/1968 | United Kingdom | 37/141 R |
| 859,910 | 1/1961 | United Kingdom | 37/141 R |
| 980,589 | 1/1965 | United Kingdom | 37/141 R |

*Primary Examiner*—E. H. Eickholt
*Attorney, Agent, or Firm*—Phillips, Moore, Weissenberger, Lempio & Strabala

[57] ABSTRACT

A loader bucket comprises a pair of vertically disposed sidewalls, a bottom wall secured between the sidewalls and a cutting edge secured on a forward end of the bottom wall. A corner reinforcement for each side of the bucket comprises a member having a bottom edge thereof secured to the cutting edge and a rearward edge thereof secured to a forward edge of a respective sidewall. A bevel is formed on an inboard side of the member to intersect the rearward edge thereof and to define an obtuse angle relative to the sidewall. A first weld secures the bevel and rearward edge of the corner member to the inboard surface and forward edge of the sidewall whereas a second weld secures the rearward edge of the corner member to an outboard surface and the forward edge of the sidewall.

7 Claims, 8 Drawing Figures

CORNER REINFORCEMENT FOR VARIOUS SIZED LOADER BUCKETS

BACKGROUND OF THE INVENTION

This invention relates to a corner reinforcement for loader buckets of the type disclosed in U.S. Pat. Nos. 3,014,293 and 3,736,675, both assigned to the assignee of this application. Such conventional corner reinforcements comprise a corner member which is tailored for a particular bucket size and suitably welded to a sidewall and cutting edge of the bucket. It is desirable with such corner reinforcement to not only increase the structural integrity of the loader bucket but to also aid in the smooth flow of material into and out of the bucket.

SUMMARY OF THIS INVENTION

An object of this invention is to provide an improved corner reinforcement for a loader bucket which exhibits a high degree of structural integrity, is adapted for use on loaded buckets of various sizes, and aids in the smooth flow of material into and out of the loader bucket during operation thereof. The reinforcement comprises a corner member having its bottom edge secured to a cutting edge of the loader bucket and a straight rearward edge thereof secured to a straight forward edge of a respective sidewall of the bucket. The corner member is substantially thicker than the sidewall and the rearward edge thereof is flat and is disposed closely adjacent and parallel to the forward edge of the sidewall. A bevel is formed on an inboard side of the corner member to intersect the rearward edge thereof to define an obtuse angle relative to an inboard surface of the sidewall. A first weld secures the bevel and the rearward edge of the corner member to the inboard surface and forward edge of the sidewall whereas a second weld secures the rearward edge of the corner member to an outboard surface and the forward edge of the sidewall.

BRIEF DESCRIPTION OF THE DRAWINGS

Other objects of this invention will become apparent from the following description and accompanying drawings wherein.

DETAILED DESCRIPTION

Figure 1:
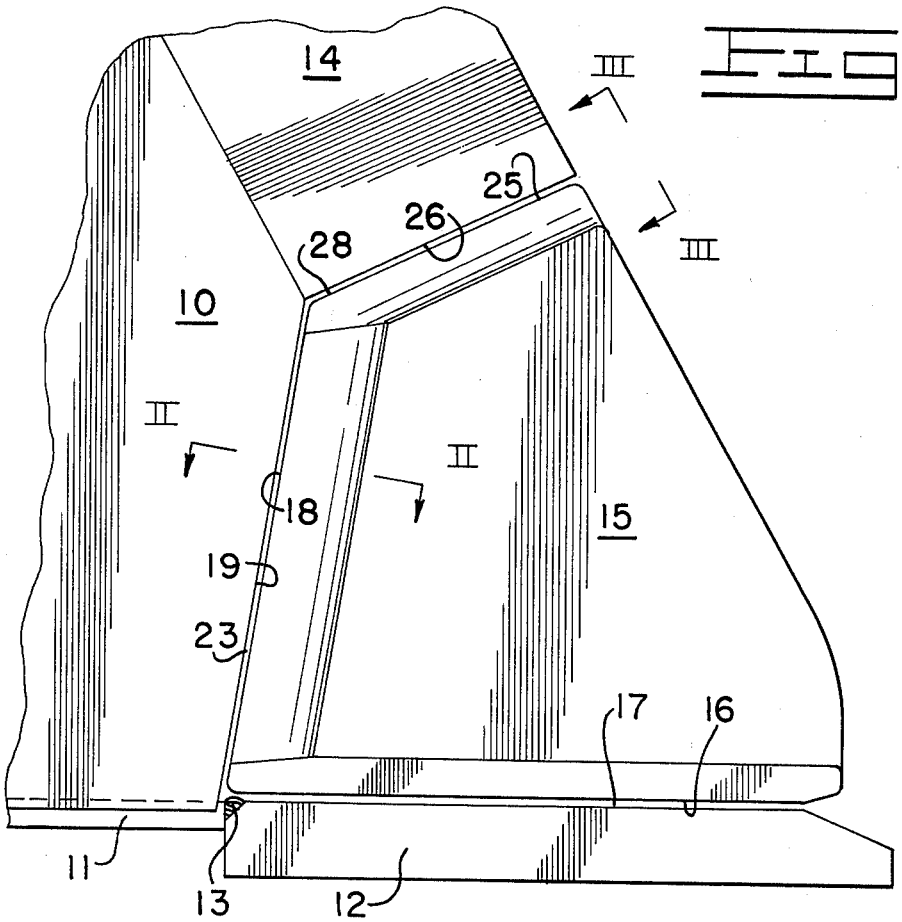
FIG. 1 is a side elevational view of a corner reinforcement for a loader bucket embodying this invention.

FIG. 1 illustrates a portion of a loader bucket comprising a pair of vertically disposed and laterally spaced sidewalls 10 (one shown) and a horizontally disposed bottom wall 11 secured therebetween. A horizontally disposed cutting edge is secured on a forward edge of the bottom wall by a weld 13. In addition, hardened members or wear plates 14 are secured to each of the sidewalls.

Figure 2:
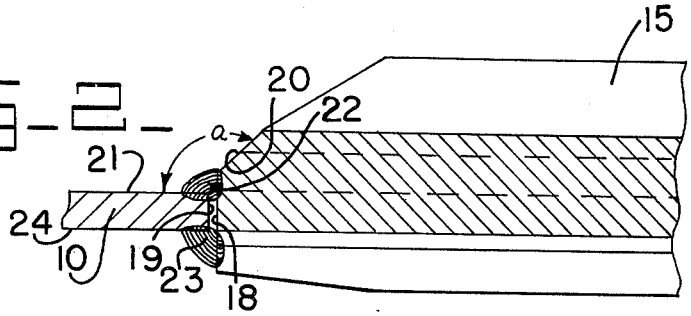
FIG. 2 is an enlarged sectional view taken in the direction of arrows II—II in FIG. 1.

This invention relates to a corner reinforcement for the bucket comprising a hardened corner member 15 secured to each sidewall and to the cutting edge. In particular, the vertically disposed corner member has a straight bottom edge 16 secured on the cutting edge by a weld 17 and a straight rearward edge 18 secured to a straight forward edge 19 of the sidewall. Referring to FIG. 2, the corner member and rearward edge 18 thereof are substantially thicker than the sidewall and the rearward edge hereof is flat and is disposed closely adjacent and parallel to straight forward edge 19 of the sidewall.

A bevel 20 is formed on an inboard side of the corner member to intersect edge 18 to define an obtuse angle *a* with respect to an inboard surface 21 of the sidewall. Such angle, illustrated as approximating 143°, is preferably selected from the range of from 125° to 165°. A first elongated weld 22 secures bevel 20 and rearward edge 18 of the corner member to inboard surface 21 and forward edge 19 of the sidewall.

Figure 3:
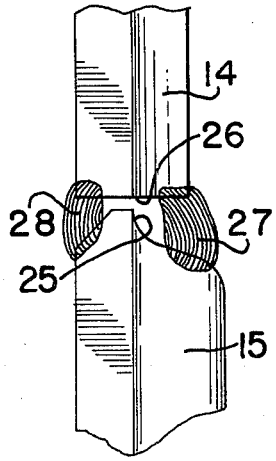
FIG. 3 is a view taken in the direction of arrows III—III in FIG. 1.

A second elongated weld 23 secures rearward edge 18 of the corner member to an outboard surface 24 and forward edge 19 of the sidewall. Edges 18 and 19, bevel 20 and welds 22 and 23 are at least substantially coextensive throughout their lengths to provide substantial structural integrity at the corner of the bucket. Referring to FIG. 3, an upper edge 25 of the corner member is secured to a lower edge 26 of member 14 by a pair of straight welds 27 and 28 disposed on outboard and inboard sides thereof, respectively.

It can thus be seen that the above-described corner reinforcement provides substantial structural integrity at the corners of the bucket as well as inducing a smooth flow of material into and out of the bucket due to the construction and arrangement of bevel 20 of the corner member relative to inboard surface 21 of the sidewall. In addition, FIGS. 4–8 illustrate the adaption of corner member 15 to buckets having various sizes, i.e., varied gauge widths between their sidewalls and/or varied thicknesses of the sidewalls.

Figure 4:
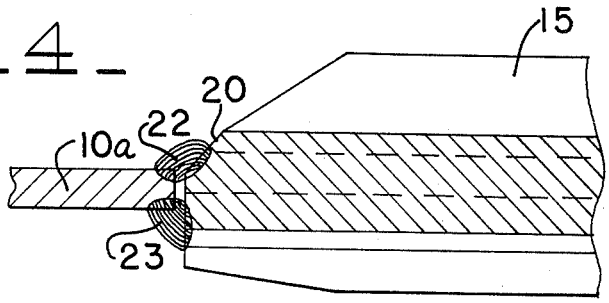
FIGS. 4–8 are views similar to FIG. 2, but illustrating the application of a corner member of such reinforcement to various sized loader buckets.

In FIG. 2 sidewall 10 is disposed intermediate rearward edge 18 of the corner member whereas in FIG. 4, for example, a sidewall 10*a* is moved inboard closely adjacent to bevel 20 and towards the center of the bucket relative to the disposition of sidewall 10. Welds 22 and 23 are still capable of providing the corner reinforcement with its required structural integrity as well as providing non-interference with the smooth flow of material into and out of the bucket.

Figure 5:
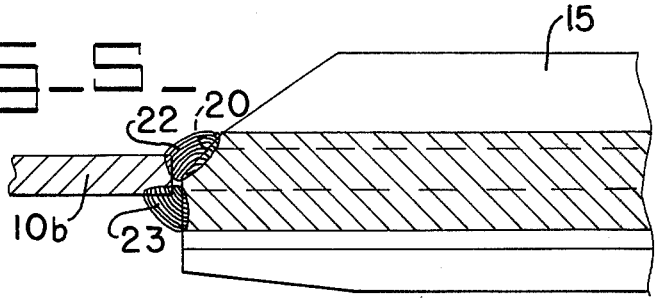
Figure 6:
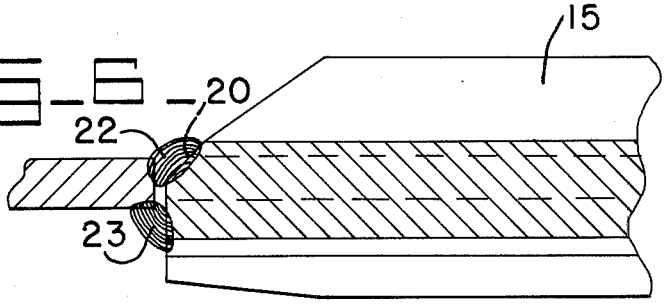
Figure 7:
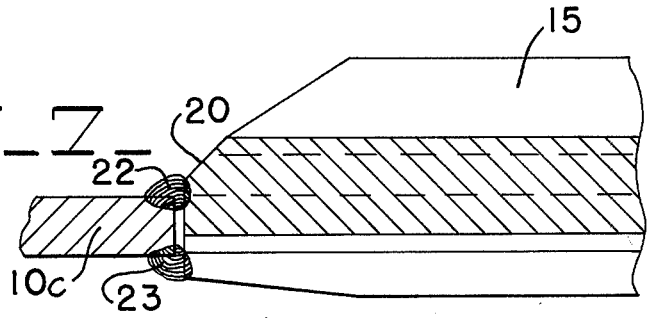
Figure 8:
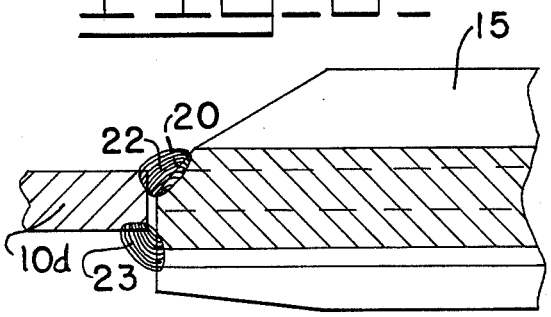

FIGS. 5 and 6 disclose sidewalls 10*b* and 10*c*, respectively, which have been moved still further inboard towards the center of the bucket and in overlapping relationship with respect to bevel 20. FIGS. 7 and 8 illustrate substantially thicker sidewalls 10*d* and 10*e*, respectively, which are suitably positioned and secured to corner member 15 by welds 22 and 23 to provide the above-mentioned desiderata for the loader bucket.

We claim:

1. In a loader bucket of the type comprising a pair of vertically disposed sidewalls, a bottom wall, a horizontally disposed cutting edge secured on a forward edge of said bottom wall and extending transversely thereacross between said sidewalls and vertically disposed corner members having a bottom edge thereof secured to said cutting edge and a straight rearward edge therof secured to a straight forward edge of a respective sidewall, the improvement wherein said corner member is substantially thicker than said sidewall and the rearward edge thereof is entirely flat and is disposed closely adjacent and parallel to the straight forward edge of said respective sidewall, a bevel formed on an inboard side of said corner member to intersect the rearward edge thereof to define an obtuse angle with respect to an inboard surface of said sidewall, a first weld securing the bevel and the rearward edge of said corner member to the inboard surface and forward edge of said sidewall, and a separate second weld securing the rearward edge of said corner member to an outboard surface and the forward edge of said sidewall.

2. The loader bucket of claim 1 wherein the rearward edge and bevel of said corner member, the forward edge of said sidewall and said first and second welds are at least substantially co-extensive.

3. The loader bucket of claim 1 wherein said obtuse angle is selected from the range of from 125° to 165°.

4. The loader bucket of claim 1 wherein the forward edge of said sidewall is disposed intermediate the rearward edge of said corner member.

5. The loader bucket of claim 1 wherein the forward edge of said sidewall is disposed closely adjacent to the rearward edge of said corner member.

6. The loader bucket of claim 1 wherein the forward edge of said sidewall is disposed in overlapping relationship relative to said bevel.

7. The loader bucket of claim 1 wherein an upper edge of said corner member is secured to a lower edge of a wear plate secured on a forward edge of said sidewall.

* * * * *